US005738342A

United States Patent [19]

Van Winkle

[11] Patent Number: 5,738,342

[45] Date of Patent: Apr. 14, 1998

[54] FENCE CORNER ARRANGEMENT WITH INTERLOCKING POSTS AND BRACES

[76] Inventor: Lonnie Van Winkle, 2116 F St., Ord, Nebr. 68862

[21] Appl. No.: 631,998

[22] Filed: Apr. 15, 1996

[51] Int. Cl.[6] ..... E04H 17/14

[52] U.S. Cl. ..... 256/65; 256/59; 256/35; 256/64

[58] Field of Search ..... 256/32, 35, 36, 256/46, 47, 48, 59, 64, 63, 65, 56, 70; 403/217, 218, 174, 178, 354

[56] References Cited

U.S. PATENT DOCUMENTS

| | | | |
|---|---|---|---|
| 230,925 | 8/1880 | Curry | 256/36 |
| 417,383 | 12/1889 | Christ | 256/59 |
| 453,148 | 5/1891 | Kiler et al. | 256/65 X |
| 3,484,827 | 12/1969 | Hall | 256/59 |
| 3,499,631 | 3/1970 | Heldenbrand | 256/59 X |
| 3,700,213 | 10/1972 | Blease | 256/59 X |
| 4,142,343 | 3/1979 | Trafton | 256/59 X |
| 4,348,129 | 9/1982 | Conforti | 403/218 |
| 4,355,918 | 10/1982 | Van Vliet | 403/218 X |
| 4,361,314 | 11/1982 | Ohlson | 256/66 X |
| 4,498,660 | 2/1985 | Brema et al. | 256/66 X |
| 4,621,938 | 11/1986 | Weilow | 403/217 |
| 4,652,170 | 3/1987 | Lew | 403/217 X |
| 4,679,772 | 7/1987 | Peterson | 256/36 |
| 4,682,761 | 7/1987 | Hanneken | 256/64 X |
| 4,702,459 | 10/1987 | Moschner | 256/66 X |
| 5,354,037 | 10/1994 | Venegas, Jr. | 256/59 |

*Primary Examiner*—Kenneth J. Dorner
*Assistant Examiner*—Bruce A. Lev

[57] ABSTRACT

A fence corner arrangement that includes a corner post, at least two corner post tongues, a first end post, a first end post tongue, a second end post, a second end post tongue, a first brace, and a second brace. The corner post has an upper portion with a perimeter and the corner post upper portion contains a recess disposed along its entire perimeter. The at least two corner post tongues are disposed within the recess and project towards the perimeter. The first end post is disposed a distance from the corner post and has an upper portion with a perimeter. The upper portion contains a recess disposed along a part of the perimeter. The first end post tongue is disposed within the recess and projects towards the perimeter in the direction of one of the at least two corner post tongues. The second end post is disposed a distance from the corner post and the first end post and has an upper portion with a perimeter. The second end post upper portion contains a recess disposed along a part of the perimeter. The second end post tongue is disposed within the upper portion recess and projects towards the perimeter in the direction of another of the at least two corner post tongues. The first brace has a first end that contains a slot that interlocks with the first end post tongue. The first brace has a second end that contains a first brace second end slot that interlocks with the one of the at least two corner post tongues. The second brace has a first end that contains a slot that interlocks with the second end post tongue. And, the second brace has a end that contains a slot that interlocks with another of the at least two corner post tongues.

13 Claims, 5 Drawing Sheets

FENCE CORNER ARRANGEMENT WITH INTERLOCKING POSTS AND BRACES

BACKGROUND OF THE INVENTION

1. Field of the Invention

The present invention relates generally to a fence. More particularly, the present invention relates to a fence corner arrangement with interlocking posts and braces.

2. Description of the Prior Art

Numerous innovations for fences have been provided in the prior art. Even though these innovations may be suitable for the specific individual purposes to which they address, they differ from the present invention in that they do not provide a fence corner arrangement with interlocking posts and braces.

Furthermore, even though these innovations may be suitable for the specific individual purposes to which they address, they would not be suitable for the purposes of the present invention as heretofore described.

SUMMARY OF THE INVENTION

Accordingly, an object of the present invention is to provide a fence corner arrangement with interlocking posts and braces that avoids the disadvantages of the prior art.

Another object of the present invention is to provide a fence corner arrangement with interlocking posts and braces and is simple and inexpensive to manufacture.

Still another object of the present invention is to provide a fence corner arrangement with interlocking posts and braces that is simple to use.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF LIST OF REFERENCE NUMERALS UTILIZED IN THE DRAWING

10-fence corner arrangement with interlocking posts and braces of the present invention
12-corner post
12A-corner post lower portion
12B-corner post upper portion
12BA-corner post upper portion recess
12BAA-corner post upper portion recess height
12BAB-corner post upper portion recess width
12BB-corner post upper portion perimeter
13-multi-sided member
13A-multi-sided member tongues
14-first end post
14A-first end post lower portion
14B-first end post upper portion
14BA-first end post upper portion recess
14BAA-first end post upper portion recess height
14BAB-first end post upper portion recess width
14BB-first end post upper portion perimeter
15-tongue
16-second end post
16A-second end post lower portion
16B-second end post upper portion
16BA-second end post upper portion recess
16BAA-second end post upper portion recess height

16BAB-second end post upper portion recess width
16BB-second end post upper portion perimeter
17-tongue
18-first brace
18A-first brace body
18B-first brace first tapered end
18BA-first brace first tapered end slot
18C-first brace second tapered end
18CA-first brace second tapered end slot
20-second brace
20A-second brace body
20B-second brace first tapered end
20BA-second brace first tapered end slot
20C-second brace second tapered end
20CA-second brace second tapered end slot
22-wires
22A-wires horizontal part
22B-wires diagonal part
23-staples

DETAILED DESCRIPTION OF THE PREFERRED EMBODIMENT

Figure 1:
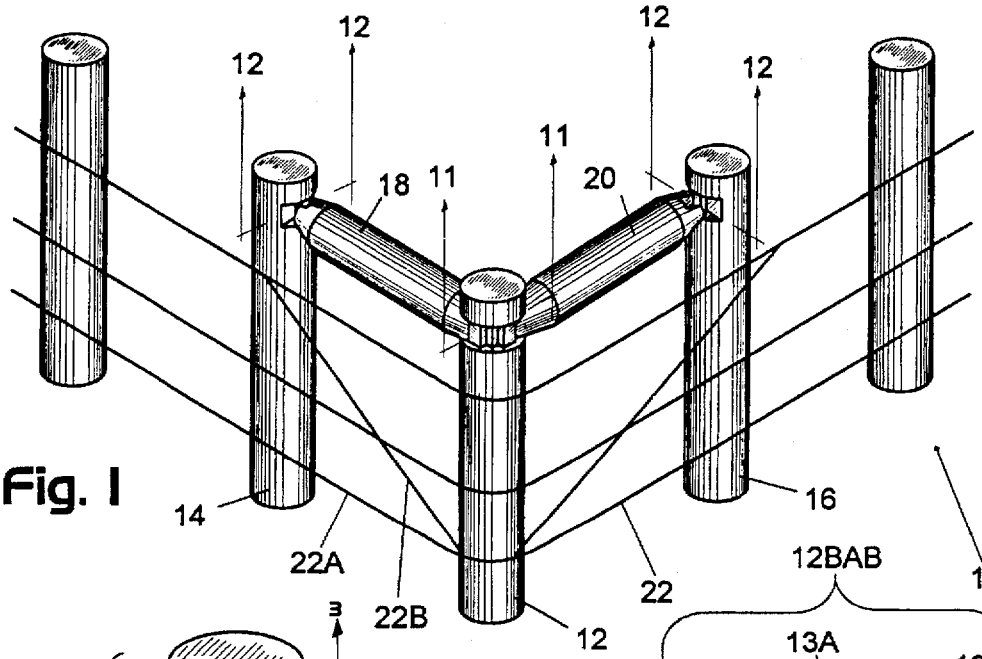
FIG. 1 is a perspective view of the corner fence arrangement of the present invention.

Referring now to the figures in which like numerals indicate like parts, and particularly to FIG. 1, the corner fence arrangement of the present invention is shown generally at 10 and includes a corner post 12, a first end post 14, a second end post 16, a first brace 18, a second brace 20, and fence wire 22.

The first brace 18 connects the first end post 14 to the corner post 12 and the second brace 20 connects the second end post 16 to the corner post 12. The fence wire 22 includes a plurality of fence wire horizontal parts 22A and a pair of fence wire diagonal parts 22B which provide stability to the corner fence arrangement 10.

Figure 2:
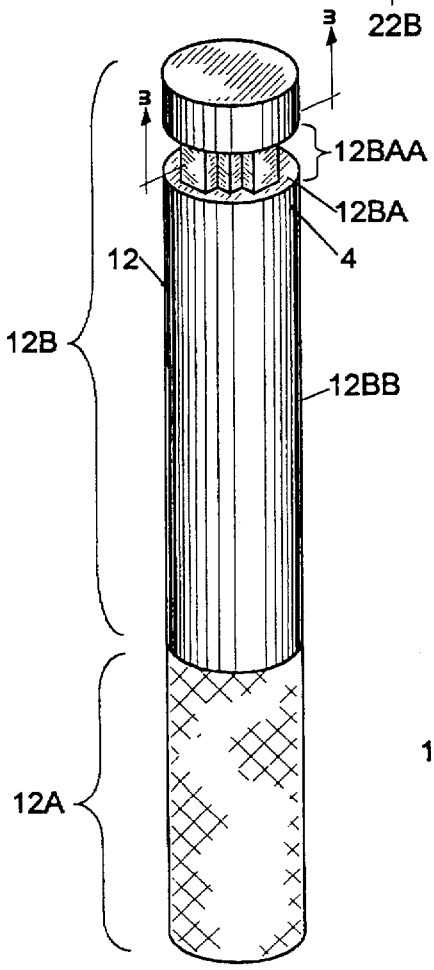
FIG. 2 is a perspective view of the corner post thereof.
Figure 3:
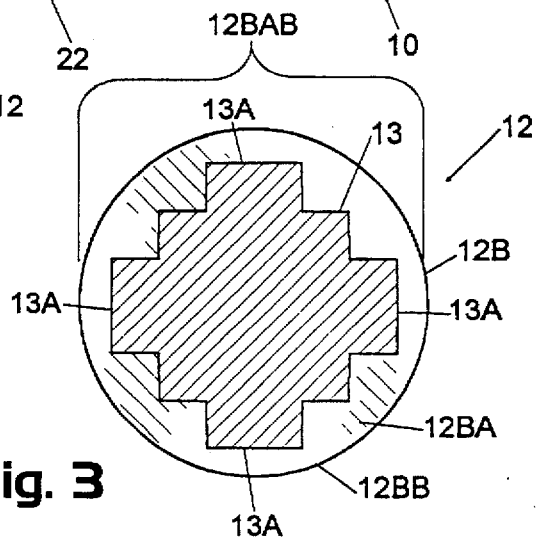
FIG. 3 is a cross sectional view taken along line 3—3 of FIG. 2.
Figure 4:
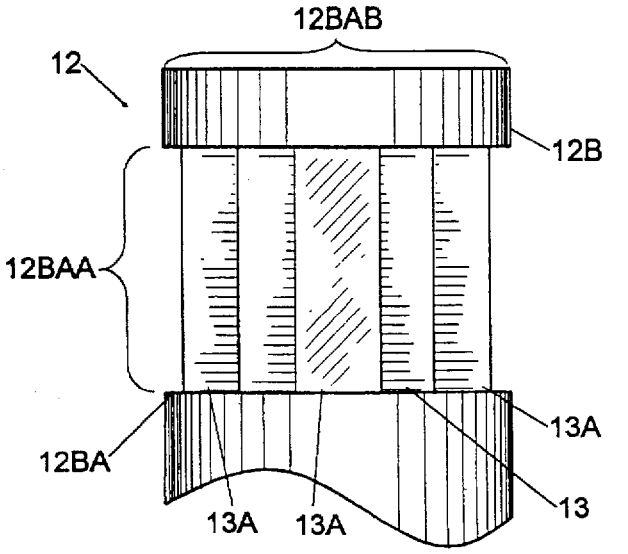
FIG. 4 is a side view taken in the direction of arrow 4 in FIG. 2.

The configuration of the corner post 12 can best be seen in FIGS. 2–4, and as such, will be discussed with reference thereto.

The corner post 12 is substantially cylindrical in shape and includes a corner post lower portion 12A and a corner post upper portion 12B. The corner post lower portion 12A is marked to indicate the correct ground depth. This facilitates placement when the corner post 12 is installed in the ground. The corner post upper portion 12B contains a corner post upper portion recess 12BA that spans the entire circumference of the corner post upper portion 12B.

Disposed within the corner post upper portion recess 12BA at the corner post longitudinal axis, is a four sided member 13. The four sided member 13 extends the entire corner post upper portion recess height 12BAA but not the entire corner post upper portion recess width 12BAB. Extending outwardly from each side of the four member 13 is a tongue 13A. The tongue 13A terminates before the corner post upper portion outer surface 12BB and does not span the entire length of the side from which in eminates.

Figure 5:
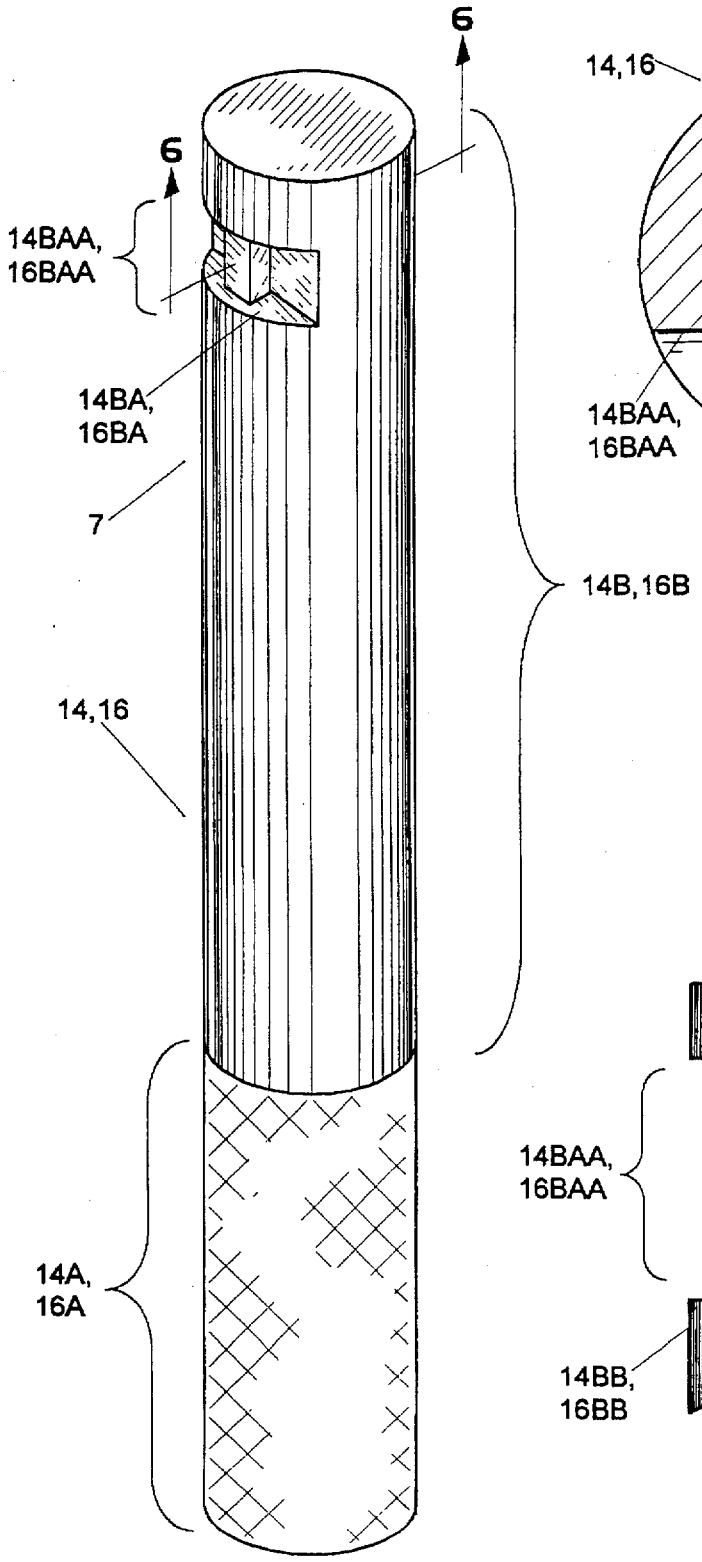
FIG. 5 is a perspective view of the end post of the present invention.
Figure 6:
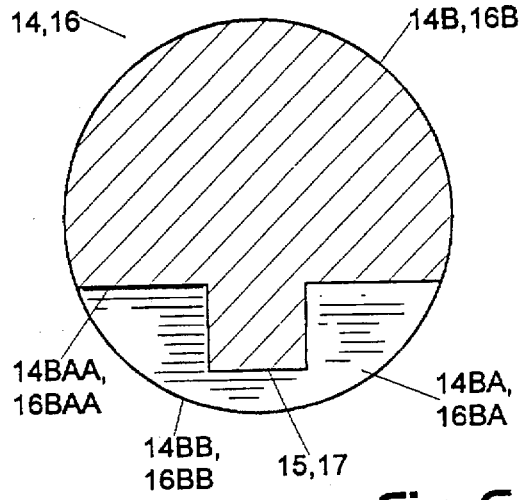
FIG. 6 is a cross sectional view taken along line 6—6 of FIG. 5.
Figure 7:
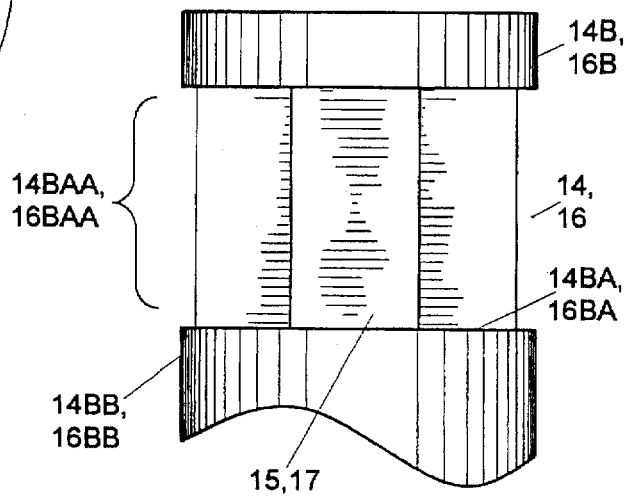
FIG. 7 is a side view in the direction of arrow 7 in FIG. 5.
Figure 8:
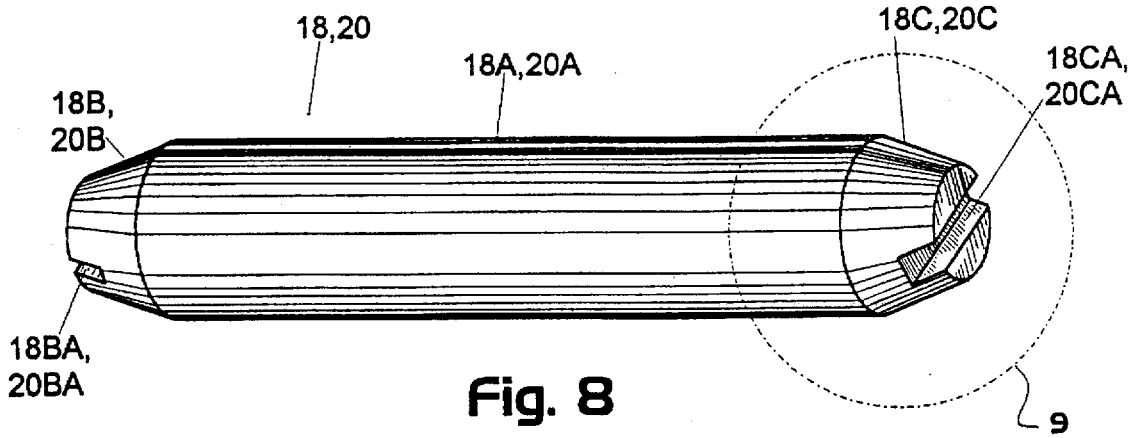
FIG. 8 is a perspective view of the brace of the present invention.
Figure 9:
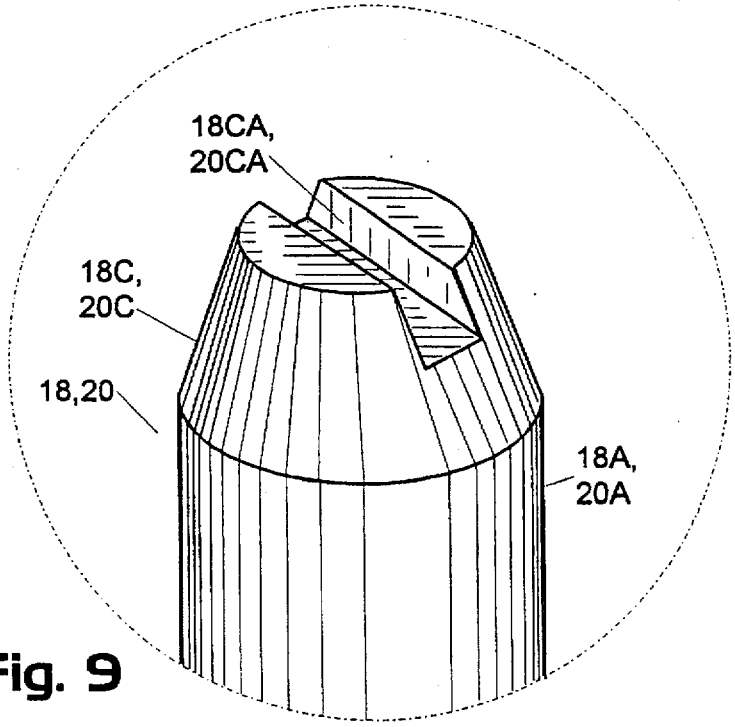
FIG. 9 is a fragmented perspective view of the area enclosed by the dotted circle 9 in FIG. 8.

The configuration of the first end post 14 can best be seen in FIGS. 5–7, and as such, will be discussed with reference thereto.

The first end post 14 is substantially cylindrical in shape and includes a first end post lower portion 14A and a first end post upper portion 14B. The first end post lower portion 14A is marked to indicate the correct ground depth. This facilitates placement when the first end post 14 is installed in the ground. The first end post upper portion 14B contains a first end post upper portion recess 14BA that extends the entire first end post upper portion recess height 14BAA but spans only a portion of the circumference of the first end post upper portion 14B.

Disposed within the first end post upper portion recess 14BA is a tongue 15. The tongue 15 eminates from a first end post upper recess cord 14BAA that defines the first corner post upper portion recess 14BA, terminates before the first end post upper portion outer surface 14BB, and does not span the entire length of the cord 14BAA.

The configuration of the second end post 16 can best be seen in FIGS. 5–7, and as such, will be discussed with reference thereto.

The second end post 16 is substantially cylindrical in shape and includes a second end post lower portion 16A and a second end post upper portion 16B. The second end post lower portion 16A is marked to indicate the correct ground depth. This facilitates placement when the second end post 16 is installed in the ground. The second end post upper portion 16B contains a second end post upper portion recess 16BA that spans only a portion of the circumference of the second end post upper portion 16B.

Disposed within the second end post upper portion recess 16BA is a tongue 15. The tongue 15 emanates from a second end post upper portion recess cord 16BAA which defines the second end post upper portion recess 16BA, terminates before the second end post upper portion outer surface 16BB, and does not span the entire length of the cord 16BAA.

The configuration of the first brace 18 can best be seen in FIGS. 3 and 4, and as such, will be discussed with reference thereto.

The first brace 18 is substantially cylindrical in shape and includes a first brace main portion 18A, a first brace first end portion 18B that tapers away from the first brace main portion 18A, and a first brace second end portion 18C that also tapers away from the first brace main portion 18A. The first brace first end portion 18B contains a first brace first end portion recess 18BA disposed on and spanning the entire width of its tapered side. The first brace second end portion 18C contains a first brace second end portion recess 18CA disposed on and spanning the entire width of its tapered side.

The configuration of the second brace 20 can best be seen in FIGS. 3 and 4, and as such, will be discussed with reference thereto.

The second brace 20 is substantially cylindrical in shape and includes a second brace main portion 20A, a second brace second end portion 20B that tapers away from the second brace main portion 20A, and a second brace second end portion 20C that also tapers away from the second brace main portion 20A. The second brace second end portion 20B contains a second brace second end portion recess 20BA disposed on and spanning the entire width of its tapered side. The second brace second end portion 20C contains a second brace second end portion recess 20CA disposed on and spanning the entire width of its tapered side.

Figure 10:
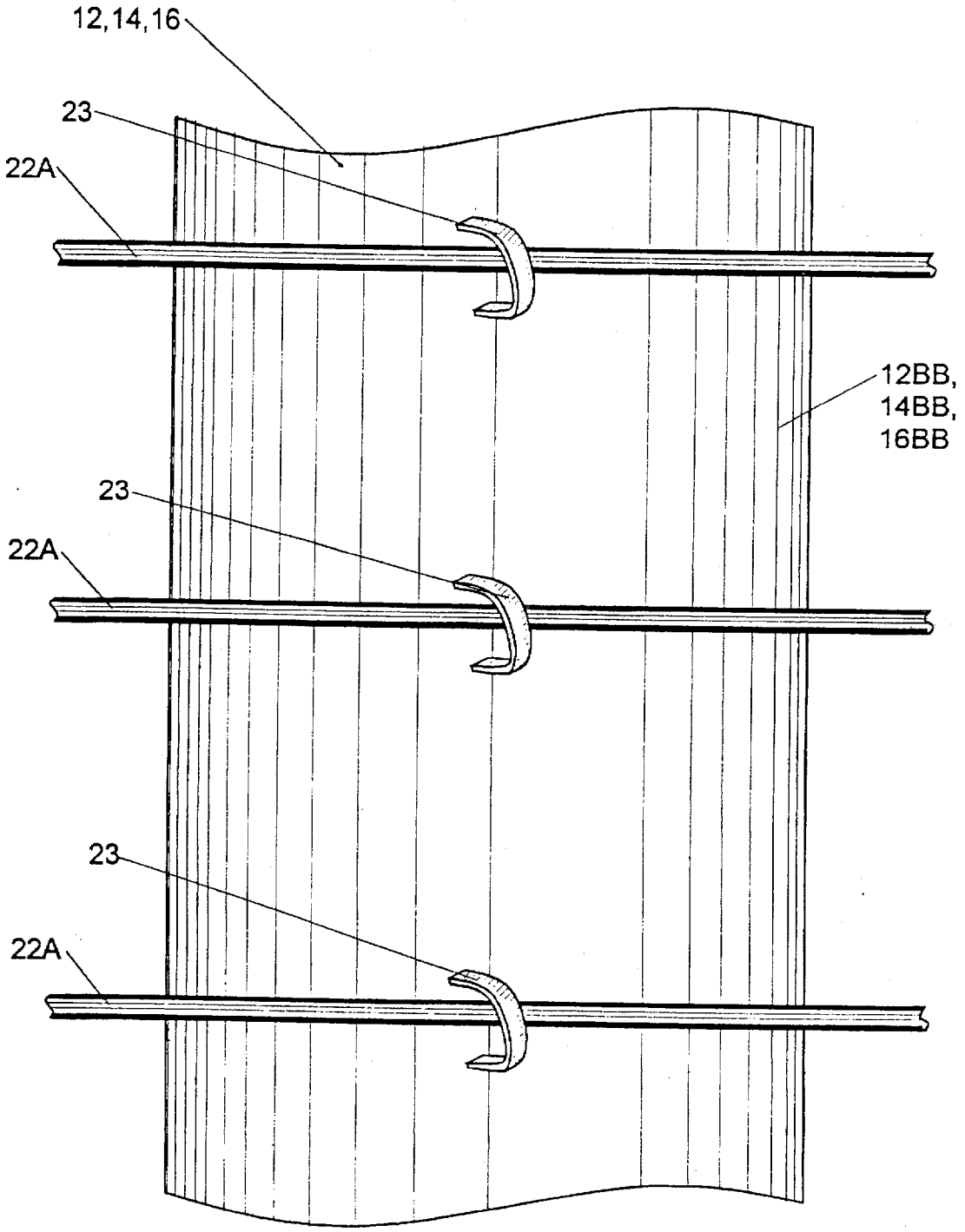
FIG. 10 is a perspective view of the fence wire stapled to a post.

The configuration of the fence wire 22 can best be seen in FIG. 10, and as such, will be discussed with reference thereto.

The plurality of fence wire horizontal parts 22A pass along the first end post outer surface 14BB, the corner post outer surface 12BB, and the second end post outer surface 16BB. The plurality of fence wire horizontal parts 22A are secured to the first end post outer surface 14BB, the corner post outer surface 12BB, and the second end post outer surface 16BB by staples 23.

Figure 11:
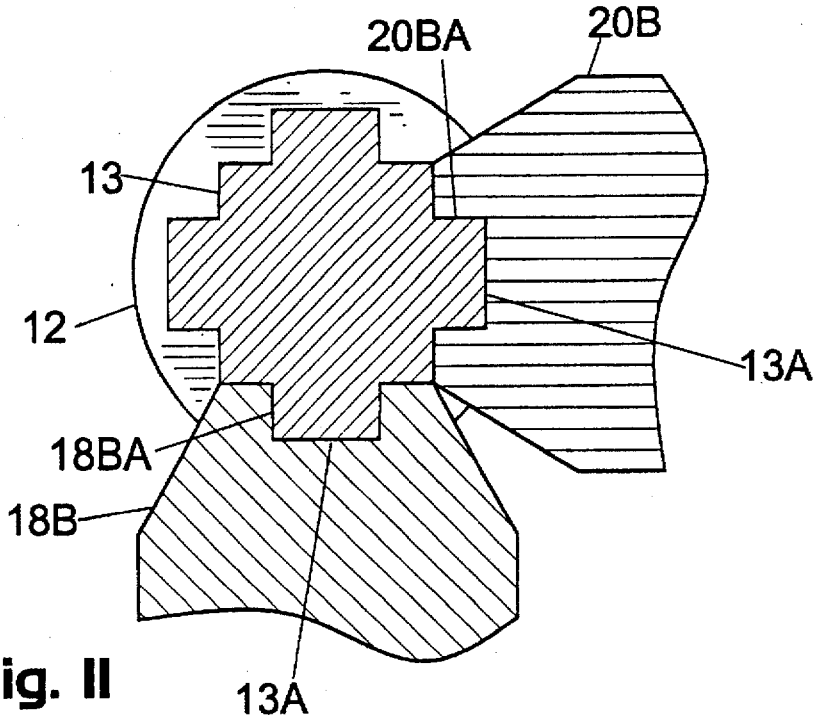
FIG. 11 is a cross sectional view taken along line 11—11 of FIG. 1.
Figure 12:
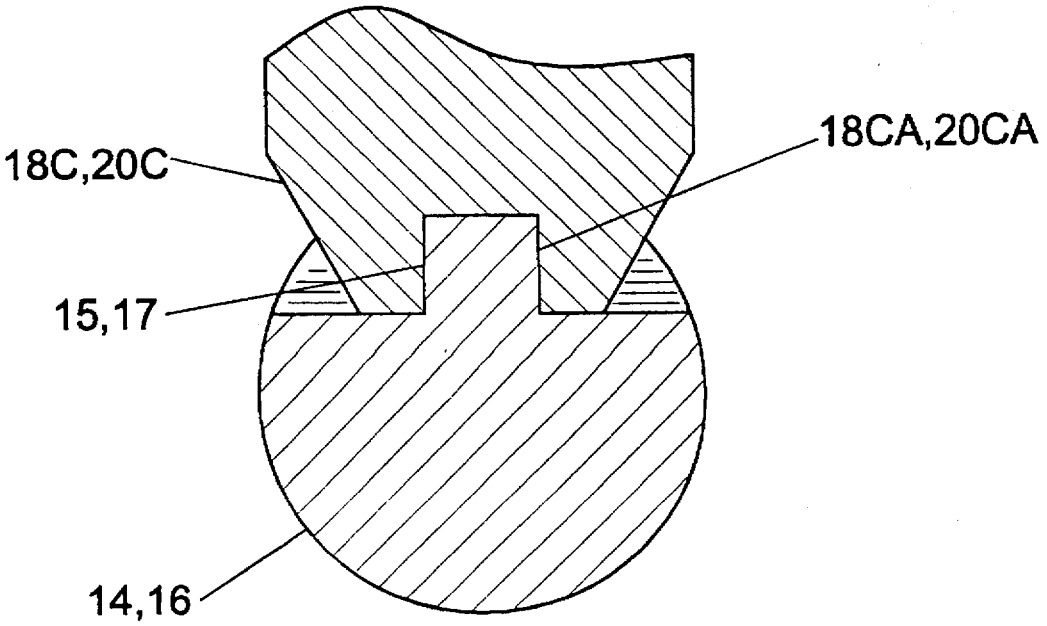
FIG. 12 is a cross sectional view taken along line 12—12 of FIG. 1.

The installation of the fence corner 10 can best be seen in FIGS. 1, 11, and 12, and as such will be discussed with reference thereto.

The corner post 12 is positioned on the ground with the corner post lower portion 12A below ground level and two of the tongues 13A facing in the direction of the subsequent placement of the first end post 14 and the second end post 16. The first end post 14 is then positioned on the ground a distance from the corner post 12 with the first end post lower portion 14A below ground level and the tongue 15 facing in the direction of one tongue 13A. The first brace 18 is then placed between the first end post 14 and the corner post 12 with the first brace second end portion 18C resting within the first end post upper portion recess 14BA and the first brace first end portion 18B resting within the center post upper portion recess 12BA. The first end post upper portion tongue 15 interlocks with the first brace second end recess 18CA and becomes secured therein and the corner post upper portion tongue 13A interlocks with the first brace first end recess 18BA and becomes secured therein. The second end post 16 is then positioned on the ground a distance from the corner post 12 and the first end post 14 with the second end post lower portion 16A below ground level and the tongue 17 facing in the direction the other tongue 13A. The second brace 20 is placed between the second end post 16 and the corner post 12 with the second brace second end portion 20C resting within the second end post upper portion recess 16BA and the second brace first end portion 20B resting within the center post upper portion recess 12BA. The second end post upper portion tongue 17 interlocks with the second brace second end recess 20CA and becomes secured therein and the corner post upper portion tongue 13A interlocks with the second brace first end recess 20BA and becomes secured therein. The second end post 16 can be installed before the first end post 14 and the second brace 20 can be installed before the first brace 18.

It will be understood that each of the elements described above, or two or more together, may also find a useful application in other types of constructions differing from the type described above.

While the invention has been illustrated and described as embodied in a fence corner post arrangement with interlocking posts and braces, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A fence corner arrangement, comprising:

a) a corner post having a corner post upper portion with a corner post upper portion perimeter, said corner post upper portion containing a corner post upper portion recess disposed along the entire said corner post upper portion perimeter;

b) at least two corner post tongues disposed within said corner post upper portion recess and projecting towards said corner post upper portion perimeter;

c) a first end post disposed a distance from said corner post and having a first end post upper portion with a first end post upper portion perimeter, said first end post upper portion containing a first end post upper portion recess disposed a part of said first end post upper portion perimeter;

d) a first end post tongue disposed within said first end post upper portion recess and projecting towards said first end post upper portion perimeter in the direction of one of said at least two corner post tongues;

e) a second end post disposed a distance from said corner post and said first end post, said second end post having a second end post upper portion with a second end post upper portion perimeter, said second end post upper portion containing a second end post upper portion recess disposed a part of said second end post upper portion perimeter;

f) a second end post tongue disposed within said second end post upper portion recess and projecting towards said second end post upper portion perimeter in the direction of another of said at least two corner post tongues;

g) a first brace having a first brace first end containing a first brace first end slot interlocking with said first end post tongue, said first brace having a first brace second end containing a first brace second end slot interlocking with said one of said at least two corner post tongues; and h) a second brace having a second brace first end containing a second brace first end slot interlocking with said second end post tongue, said second brace having a second brace second end containing a second brace second end slot interlocking with said another of said at least two corner post tongues.

2. The arrangement as defined in claim 1, wherein said first brace first end and said first brace second end taper away from each other.

3. The arrangement as defined in claim 1, wherein said second brace first end and said second brace second end taper away from each other.

4. The arrangement as defined in claim 1, wherein said corner post is cylindrical.

5. The arrangement as defined in claim 1, wherein said first end post is cylindrical.

6. The arrangement as defined in claim 1, wherein said second end post is cylindrical.

7. The arrangement as defined in claim 1, wherein each of said at least two corner posts tongues are rectangular.

8. The arrangement as defined in claim 1, wherein said first end post tongue is rectangular.

9. The arrangement as defined in claim 1, wherein said second end post tongue is rectangular.

10. The arrangement as defined in claim 1; further comprising a plurality of wires attached to said corner post, said first end post, and said second end post.

11. The arrangement as defined in claim 10, wherein, said plurality of wires have plurality of horizontal wires and a plurality of diagonal wires.

12. The arrangement as defined in claim 11; further comprising attaching means for attaching said plurality of wires to said corner post, said first end post, and said second end post.

13. The arrangement as defined in claim 12, wherein said attaching means includes staples.

* * * * *